United States Patent [19]

Langenbach et al.

[11] Patent Number: 4,679,353

[45] Date of Patent: Jul. 14, 1987

[54] SECURITY DOOR

[76] Inventors: George Langenbach, 9127 Pardee Spur; John F. Langenbach, 9017 Firewood Trail, both of St. Louis, Mo. 63126

[21] Appl. No.: 912,259

[22] Filed: Sep. 29, 1986

[51] Int. Cl.[4] ..... E05D 15/58

[52] U.S. Cl. ..... 49/257; 49/254; 49/449; 49/379

[58] Field of Search ..... 49/394, 254, 257, 379, 49/449; 109/70

[56] References Cited

U.S. PATENT DOCUMENTS

| | | | |
|---|---|---|---|
| 915,397 | 3/1909 | Weiss | 49/257 X |
| 1,473,494 | 11/1923 | Miely | 49/254 X |
| 4,070,074 | 1/1978 | Rohme | 49/257 X |
| 4,294,040 | 10/1981 | Crotti | 49/257 X |

*Primary Examiner*—Kenneth Downey

*Attorney, Agent, or Firm*—Senniger, Powers, Leavitt and Roedel

[57] ABSTRACT

A security door comprises first and second vertical door jambs spaced from one another to define a doorway therebetween, and a door for closing the doorway. The second door jamb has a generally channel-shaped recess therein extending generally vertically from adjacent the bottom of the jamb to adjacent the top of the jamb. The security door includes a hinge on the first door jamb for supporting the door adjacent one vertical edge of the door, constituting its inner edge. The hinge enables the door to swing on a generally vertical axis between an open position wherein the door is swung out of the doorway and a closed position wherein the door closes the doorway and the opposite vertical edge of the door, constituting its outer edge, is spaced inwardly from the recess in the second door jamb. The door is movable outwardly in the plane of the doorway from its closed position to a secured position wherein the outer vertical edge is received in the vertical recess thereby to prevent the door from swinging out of its secured position. The security door further includes springs for urging the door away from its secured position and locking apparatus operable to pull the outer vertical edge of the door into the vertical recess and to maintain the door in its secured position against the urging of the springs. The locking apparatus comprises cooperable locking components in the door and the second door jamb.

15 Claims, 7 Drawing Figures

SECURITY DOOR

BACKGROUND OF THE INVENTION

This invention relates generally to doors, and more particularly to a security door that is especially designed to withstand attempts to force it open.

Ordinary doors can be kicked, pried or forced open, the portion of the jamb near a dead bolt being broken by the force. One approach to this problem is to build up or otherwise strengthen the jamb adjacent the bolt plate. Another approach, disclosed in U.S. Pat. Nos. 915,397 and 4,294,040, is to spread the force over the entire jamb or over the entire door frame.

U.S. Pat. No. 915,397 discloses a vault door movable by sliding and swinging. The door can be manually swung open and closed. When the door is closed, the outer edge of the vault door is slidable into a vertical channel in the door jamb to protect against the door being blown open. The door is locked by rotation of a hand wheel, which by turning a screw drives two levers, thereby pushing the door (on pivot balls) into the channel in the door jamb. When the door slides into the channel, projections on the top and bottom of the door engage ribs on the top and bottom of the door frame, a bolt engages the inner edge of the door, and projections on the inner edge of the door enter recesses in the door jamb. However, this door is heavy and unwieldy to open and close which makes it unsuitable for residential and many commercial buildings.

U.S. Pat. No. 4,294,040 discloses a two-part safety door for buildings and rooms which is intended for use in residential houses. The door comprises a door body and a supporting column, slidable from an unsecured position to a secured position wherein the outer vertical edge of the door body is received in a cavity in the jamb. The door can be locked in the secured position by vertical latches. When a handle is pulled, the door body and the supporting column slide on guides. In its unsecured position, the door body can rotate on hinges attached to the supporting column. Since both the door and the supporting column must be manually slid to secure this door, this door is unwieldy for many people and uses. In addition, the door and supporting column must be manually slid to the unsecured position.

Accordingly, there is a need for a security door which is capable of withstanding kicking or prying without breaking open and which may be easily opened by those, including handicapped people or children, who are authorized to do so. Some means should be provided so that such a door may be shifted to its secured position without requiring the user to pull or push the door, and means should be provided for returning the door to its unsecured position when the door is unlocked. In addition to a secured position within the jamb, such a door should be capable of being latched or locked in the closed (but unsecured) position in the same way that a conventional door is locked.

SUMMARY OF THE INVENTION

Among the several objects of the invention may be noted the provision of an improved security door, particularly adapted to withstand attempts to force it open, such as by kicking or prying, thereby to securely close a doorway to unauthorized people; the provision of such a door which is easily secured and which is readily openable and closable when not so secured; the provision of such a door which is openable to either side of the doorway; the provision of such a door that may be latched (but not secured) or secured; and the provision of such a door that is efficient and durable.

Generally, a security door of the present invention comprises first and second vertical door jambs spaced from one another to define a doorway therebetween, and a door for closing the doorway. The second door jamb has a generally channel-shaped recess therein extending generally vertically from adjacent the bottom of the jamb to adjacent the top of the jamb. The security door includes hinge means on the first door jamb for supporting the door adjacent one vertical edge of the door, constituting its inner edge. The hinge means enables the door to swing on a generally vertical axis between an open position wherein the door is swung out of the doorway and a closed position wherein the door closes the doorway and the opposite vertical edge of the door, constituting its outer edge, is spaced inwardly from the recess in the second door jamb. The door is movable outwardly in the plane of the doorway from its closed position to a secured position wherein the outer vertical edge is received in the vertical recess thereby to prevent the door from swinging out of its secured position. The security door further includes spring means for urging the door away from its secured position and locking means operable to pull the outer vertical edge of the door into the vertical recess and to maintain the door in its secured position against the urging of the spring means. The locking means comprise cooperable locking components in the door and the second door jamb.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 2:
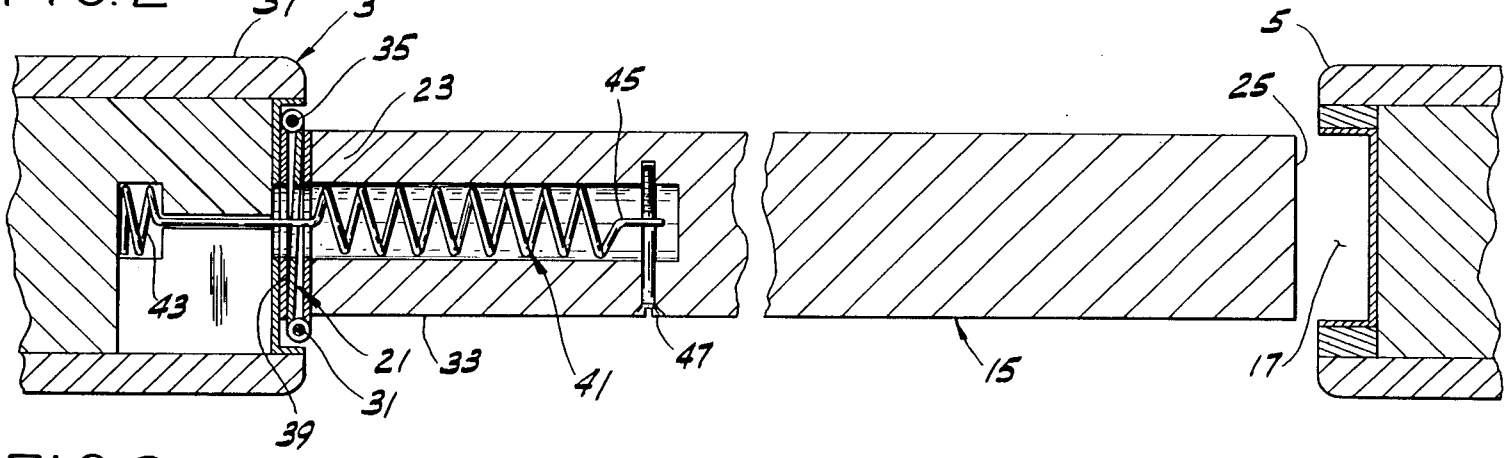
FIG. 2 is a cross-sectional view along line 2—2 of FIG. 1 showing the security door in a closed position.
Figure 3:
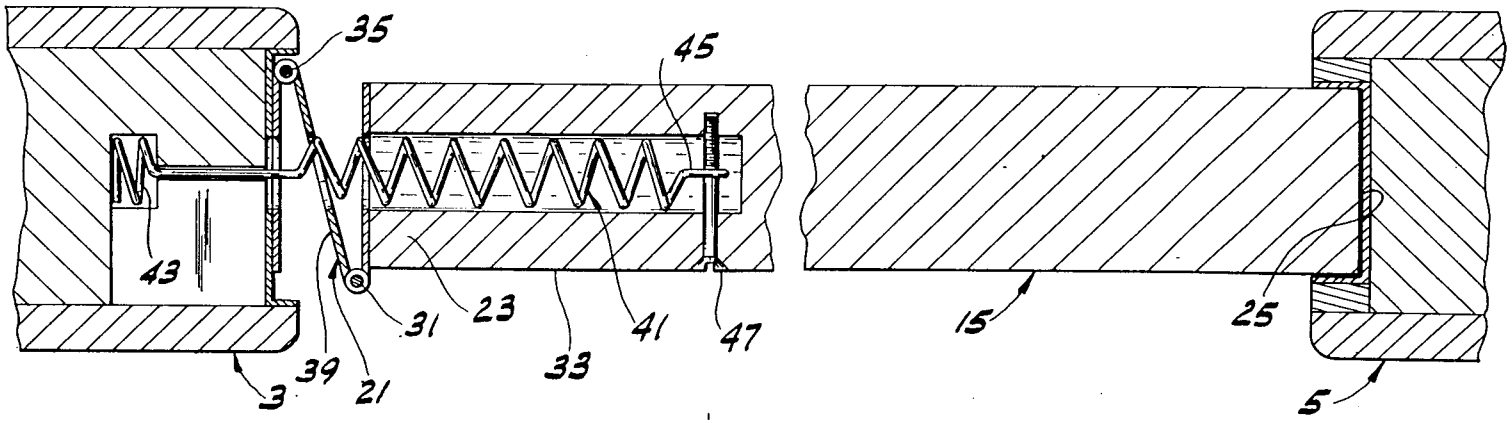
FIG. 3 is a cross-sectional view similar to FIG. 2, showing the door in a secured position.

Now referring to the drawings, a security door of the present invention is designated in its entirety by the reference numeral 1. A shown in FIG. 1, security door 1 comprises first (left) and second (right) vertical door jambs designated 3 and 5, respectively, spaced from one another to define a doorway 7 therebetween. A conventional transom 9 spans the doorway 7 from the top 11 of the left jamb to the top 13 of the right jamb. A door 15 is provided for closing doorway 7. As shown in FIGS. 2 and 3, the right door jamb 5 has a generally channel-shaped recess 17 extending generally vertically from adjacent the bottom 19 of the jamb to adjacent the top 13 of the jamb.

As shown in FIGS. 2 and 3, hinge means 21 is provided on the left door jamb 3 for supporting the door 15 adjacent one vertical edge 23 of the door. Vertical edge 23 of the door constitutes the inner edge of the door 15. Hinge means 21 enables the door 15 to swing on a generally vertical axis between an open position (not shown) wherein the door is swung out of the doorway 7 and a closed position (shown in FIG. 2) wherein the door closes the doorway and the vertical edge 25 of the door opposite to inner edge 23 is spaced inwardly from the vertical recess 17 in the right door jamb 5. Vertical edge 25 constitutes the outer edge of the door 15.

Preferably, the door 15 is selectively swingable in either direction on hinge means 21 from the closed position, shown in FIG. 2, to an open position at either side of the doorway. This may be accomplished in a number of ways, such as by providing two or more axes of rotation to the hinge means 21. FIGS. 2 and 3 illustrate such a door having one axis 31 attached to inner edge 23 of the door adjacent the outside face 33 of the door, and the other axis 35 attached to the left door jamb 3 adjacent the inside face 37 of the jamb. A hinge plate member 39 connects axis 31 to axis 35.

In addition, the door 15 is movable outwardly (left and right as viewed in FIGS. 2 and 3) in the plane of the doorway from its closed position (FIG. 2) to a secured position (FIG. 3) wherein the outer vertical edge 25 is received in the vertical recess 17 thereby to prevent the door from swinging out of its secured position. As illustrated by comparing FIGS. 2 and 3, hinge means 21 is designed for allowing the door 15 to be pulled away from the left door jamb 3 into recess 17 in the right door jamb 5. Once the door is in its secured position, it can only be kicked in or forced open if the entire right door jamb 5 breaks apart. This is to be contrasted to a conventional door (not shown) which may be forced open by merely breaking the portion of the door jamb near a dead bolt.

The door 15 is provided with spring means for urging the door away from its secured position. For example, the spring means may include a plurality of coil tension springs 41, one end 43 of each spring being captive in a recess in the left jamb 3 and the other end 45 pulling against the door (by means of a screw 47 or the like) thereby to urge the door away from its secured position. As shown in FIG. 3, the springs 41 and hinge means 21 may be expanded by pulling the door away from the left jamb 3 into right jamb 5. However, when the door is not held in such a position it tends to return to the closed position shown in FIG. 2.

Figure 4:
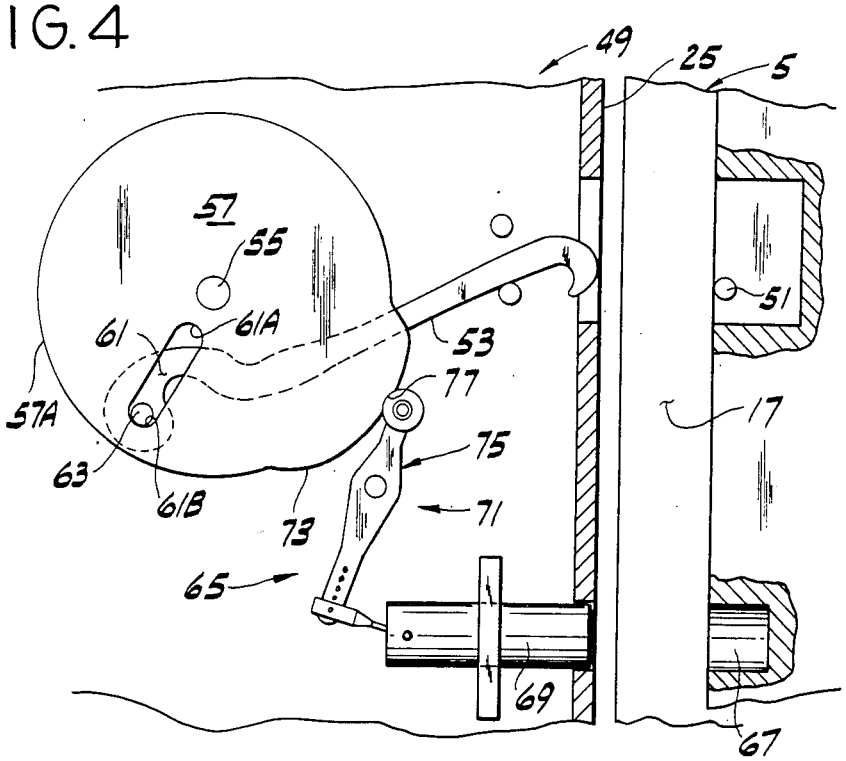
FIG. 4 is a side plan of a locking/latching mechanism for the security door of FIGS. 1–3, showing the position of the mechanism wherein the door is openable, the door being in the closed position of FIG. 2.
Figure 5:
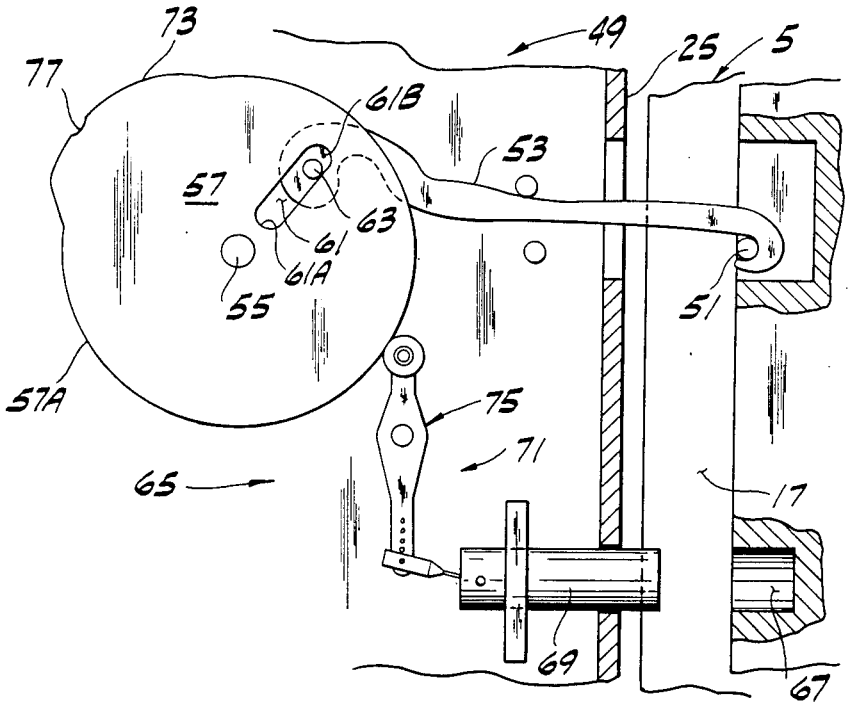
FIG. 5 is a side plan similar to FIG. 4, showing a locking member in its extended position for engaging a catch member in the second jamb.
Figure 6:
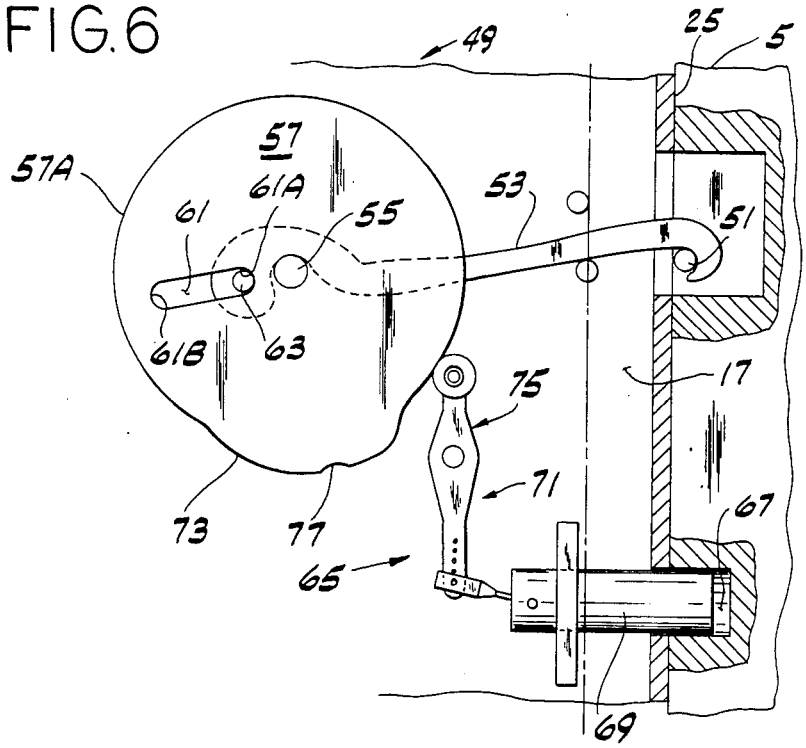
FIG. 6 is a side plan similar to FIGS. 4 and 5, showing the locking member in its retracted position wherein the door is drawn into the secured position of FIG. 3.

As shown in FIGS. 4–6, locking means 49 is provided for pulling the door into the secured position and holding it there. Locking means 49 comprises cooperable locking components in the door and the right door jamb 5. The locking components include a catch member 51 in the right door jamb 5 (e.g., locking pin 51) and a locking member 53 in the door 15 engageable with the catch member 51. The locking member 53 is formed for hooking the locking pin 51 to pull the door into its secured position (FIGS. 3 and 6) against the urging of springs 41.

Figure 1:
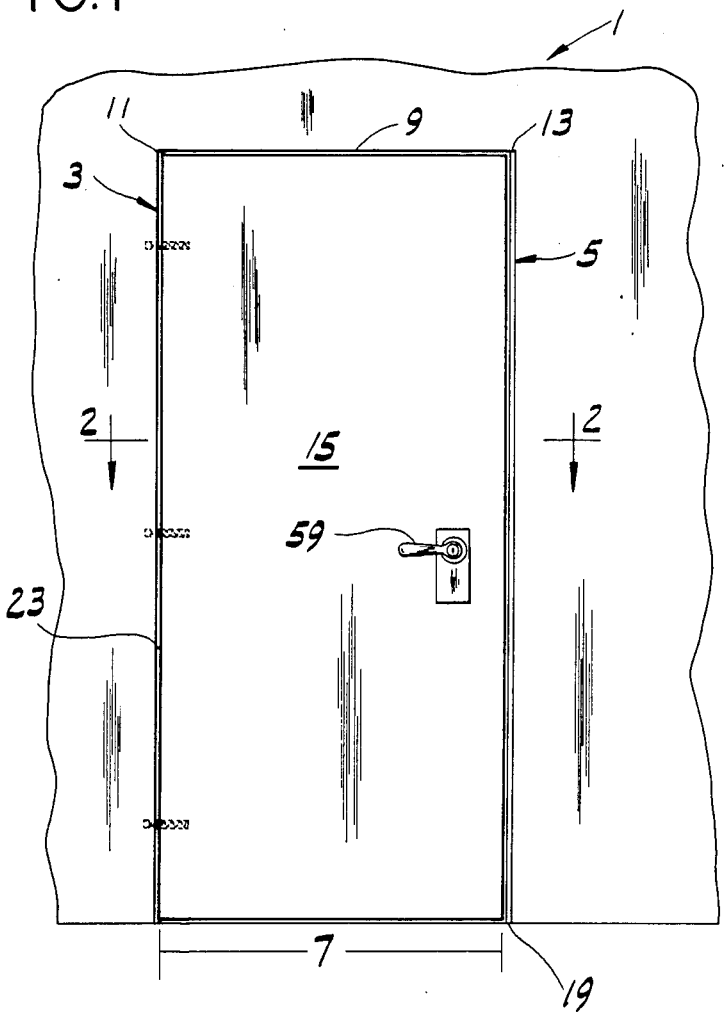
FIG. 1 is a front elevation of a security door of the present invention.

The cooperable locking components also include a crankshaft 55 in the door and an overcenter locking mechanism 57 mounted on the crankshaft 55, the locking mechanism and crankshaft being rotatable in the door by turning a handle 59, as shown in FIG. 1. Preferably, the handle is provided with a lock (not shown) designed so that the handle freewheels around the crankshaft 55 when the lock is locked and the handle rotates the crankshaft and locking mechanism 57 when the lock is unlocked.

The locking mechanism 57 preferably comprises two generally parallel spaced-apart wheel members (only one of which is shown at 57A), each of which has an elongate slot 61 positioned to retain therein a pin 63 attached to the locking member 53. Pin 63 and slots 61 are sized so that the pin may slide in the slots between the inner and outer ends 61A and 61B, respectively, as the locking mechanism 57 is rotated. This pin-and-slot arrangement is such that when the locking mechanism 57 is rotated counterclockwise from the position shown in FIG. 4, the locking member 53 is moved to an extended position (FIG. 5) in which the locking member 53 is engageable with the catch member 51 and then to a retracted position (FIG. 6) in the door 15 so that the door is drawn to its secured position (FIGS. 3 and 6). Since the pin 63 is pulled over center when the door is secured (see FIG. 6), the locking mechanism 57 tends to rotate counterclockwise if any attempt is made to force the door open, in which case the locking member 53 engages the crankshaft 55, thereby preventing further rotation of the locking mechanism and securing the door against attempts to force it open.

It will be observed that locking mechanism 57, locking member 53 and locking pin 51 constitute locking means 49 operable to pull the outer vertical edge 25 of the door 15 into the vertical recess 17 and to maintain the door 15 in its secured position (FIGS. 3 and 6) against the urging of the springs 41.

Figure 7:
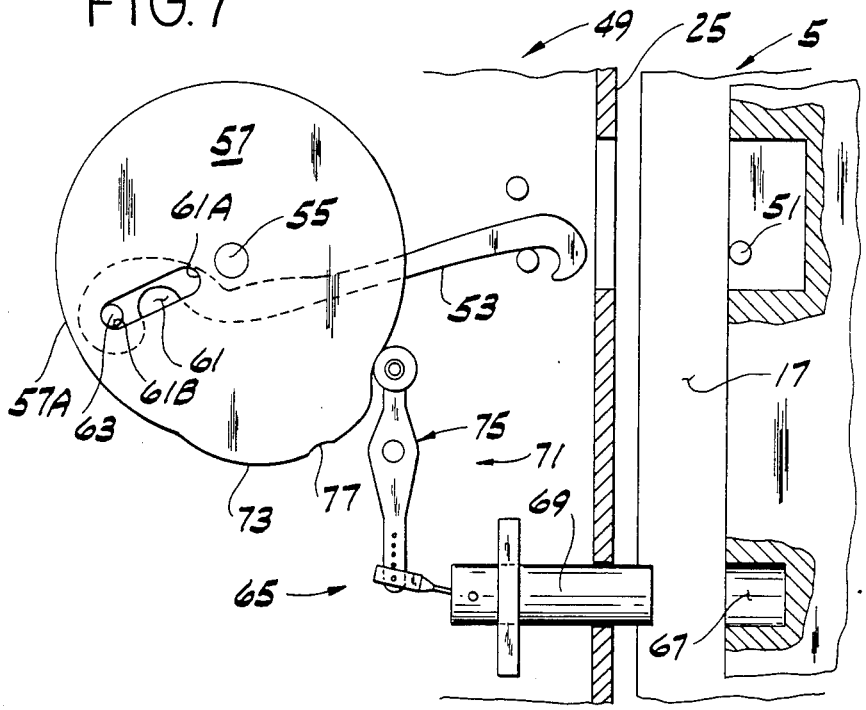
FIG. 7 is a side plan similar to FIGS. 414 6, showing a latch bolt of the locking/latching mechanism in an extended position wherein the door is latched to the second jamb in the closed position of FIG. 2.

The security door 1 also includes latching means 65 for releasably latching the door in its closed position (FIG. 7). The latching means 65 comprises a latch bolt recess 67 in the right jamb 5, a latch bolt 69 in the door and means 71 for moving the latch bolt between a retracted position (FIG. 4) wherein the latch bolt is inside the door and an extended position (FIG. 7) wherein the latch bolt projects out from the door and is received in the latch bolt recess.

More specifically, means 71 for moving the latch bolt comprises a cam surface 73 on the periphery of wheel 57A. A follower 75 is connected to the latch bolt 69 and is adapted to follow the cam surface 73 to move the latch bolt. The cam surface 73 is so configured that the latch bolt 69 is movable between the retracted and extended positions as wheel 57A is rotated. A detent 77 is formed in the cam surface 73 for the follower 75 when the latch bolt is in the retracted position (FIG. 4).

Since wheel 57A is an integral part of the locking mechanism 57, they are rotatable about a common axis (i.e. crankshaft 55). It will, therefore, be observed that, since the handle 59 is connected to the locking mechanism 57 and the wheel 57A, turning the handle causes the wheel and locking mechanism to rotate conjointly.

Preferably, the cam surface 73 is so positioned that the door 15 may be latched by rotating the handle 59 in one direction (clockwise in the drawings) to move the latch bolt 69 from its retracted position shown in FIG.

4 to its extended position shown in FIG. 7. The door 15 may be locked in the secured position of FIGS. 3 and 6 by rotating the handle 59 in the other direction (counterclockwise in the drawings) to move the locking member 53 from the retracted positon shown in FIG. 4 through its extended position shown in FIG. 5 to the retracted position shown in FIG. 6.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A security door comprising:

first and second vertical door jambs spaced from one another to define a doorway therebetween, the second door jamb having a generally channel-shaped recess therein extending generally vertically from adjacent the bottom of the jamb to adjacent the top of the jamb;

a door for closing said doorway;

hinge means on the first door jamb for supporting the door adjacent one vertical edge of the door, constituting its inner edge, and enabling it to swing on a generally vertical axis between an open position wherein the door is swung out of the doorway and a closed position wherein the door closes the doorway and the opposite vertical edge of the door, constituting its outer edge, is spaced inwardly from said recess in the second door jamb;

said door being movable outwardly in the plane of the doorway from its closed position to a secured position wherein said outer vertical edge is received in said vertical recess thereby to prevent the door from swinging out of its secured position;

spring means for urging said door away from its secured position; and locking means operable to pull the outer vertical edge of the door into said vertical recess and to maintain the door in its secured position against the urging of said spring means, said locking means comprising cooperable locking components in the door and said second door jamb.

2. A security door as set forth in claim 1 wherein the door is selectively swingable in either direction on said hinge means from said closed position to an open position at either side of the doorway.

3. A security door as set forth in claim 1 wherein said spring means comprises a plurality of tension springs connecting said first jamb and the door thereby to urge the door away from its secured position.

4. A security door as set forth in claim 1 wherein said cooperable locking components comprise a catch member in the second door jamb, a locking member in the door engageable with said catch member, an overcenter locking mechanism rotatable in the door for moving said locking member to an extended position in which the locking member is engageable with said catch member and then to a retracted position in the door whereby the door is drawn to its secured position, and a handle on the door for rotating said locking mechanism.

5. A security door as set forth in claim 4 wherein said catch member comprises a locking pin, and said locking member is formed for hooking said locking pin.

6. A security door as set forth in claim 4 further comprising latching means for releasably latching the door in its closed position.

7. A security door as set forth in claim 6 wherein said handle is rotatable in one direction to latch the door in the closed position and the other direction to pull the door from its closed position into its secured position.

8. A security door as set forth in claim 6 wherein said latching means comprises a latch bolt recess in the second jamb, a latch bolt in the door and means for moving said latch bolt between a retracted position wherein the latch bolt is inside the door and an extended position wherein the latch bolt projects out from the door and is receivable in said latch bolt recess.

9. A security door as set forth in claim 8 wherein said means for moving the latch bolt comprises a wheel having an outer cam surface, and a follower connected to said latch bolt and adapted to follow said cam surface thereby to move said latch bolt, said cam surface being so configured that the latch bolt is movable between said retracted and extended positions.

10. A security door as set forth in claim 9 wherein said wheel and said locking mechanism are rotatable about a common axis, said handle being connected to the locking mechanism and the wheel so that turning the handle causes the wheel and locking mechanism to rotate conjointly.

11. A security door as set forth in claim 1 further comprising latching means for releasably latching the door in its closed position.

12. A security door as set forth in claim 11 further comprising a handle attached to the door, the handle being rotatable in one direction to latch the door in the closed position and the other direction to pull the door from its closed position into its secured position.

13. A security door as set forth in claim 11 wherein said latching means comprises a latch bolt recess in the second jamb, a latch bolt in the door and means for moving said latch bolt between a retracted position wherein the latch bolt is inside the door and an extended position wherein the latch bolt projects out from the door and is receivable in said latch bolt recess.

14. A security door as set forth in claim 13 wherein said means for moving the latch bolt comprises a wheel having an outer cam surface, and a follower connected to said latch bolt and adapted to follow said cam surface thereby to move said latch bolt, said cam surface being so configured that the latch bolt is movable between said retracted and extended positions.

15. A security door as set forth in claim 14 further comprising a handle at the outside of the door, said handle being connected to the wheel so that turning the handle causes the wheel to rotate.

* * * * *